US011108168B2

(12) United States Patent
Rofougaran et al.

(10) Patent No.: US 11,108,168 B2
(45) Date of Patent: Aug. 31, 2021

(54) ANTENNA SYSTEM FOR PORTABLE COMMUNICATION DEVICE FOR MILLIMETER WAVE COMMUNICATION

(71) Applicant: Movandi Corporation, Irvine, CA (US)

(72) Inventors: Ahmadreza Rofougaran, Newport Beach, CA (US); Maryam Rofougaran, Rancho Palos Verdes, CA (US); Sam Gharavi, Irvine, CA (US); Raghu Mulagada, Irvine, CA (US)

(73) Assignee: SILICON VALLEY BANK, Santa Clara, CA (US)

( * ) Notice: Subject to any disclaimer, the term of this patent is extended or adjusted under 35 U.S.C. 154(b) by 137 days.

(21) Appl. No.: 16/587,225

(22) Filed: Sep. 30, 2019

(65) Prior Publication Data

US 2021/0098893 A1 Apr. 1, 2021

(51) Int. Cl.
*H01Q 1/24* (2006.01)
*H01Q 21/24* (2006.01)

(52) U.S. Cl.
CPC ..... *H01Q 21/24* (2013.01); *H01Q 1/24* (2013.01)

(58) Field of Classification Search
CPC ..... H01Q 21/24; H01Q 1/24; H01Q 1/241; H01Q 1/242; H01Q 1/243
See application file for complete search history.

(56) References Cited

U.S. PATENT DOCUMENTS

2019/0386397 A1* 12/2019 Son ..... H04B 1/40
2021/0028535 A1* 1/2021 Wu ..... H01Q 15/24

* cited by examiner

*Primary Examiner* — Dieu Hien T Duong
(74) *Attorney, Agent, or Firm* — Chip Law Group

(57) ABSTRACT

An antenna system for a portable communication device, includes a plurality of antennas configured for at least mmWave-based cellular communication, and are distributed at a plurality of different locations in the portable communication device. Each antenna of the plurality of antennas has a first polarization and a second polarization. The plurality of antennas comprises a plurality of different types of antennas. A first type of antenna of the plurality of different types of antennas is configured to switch between reception of a first radio frequency (RF) signal in a mmWave frequency and transmission of a second RF signal in the mmWave frequency in the first polarization, and concurrently with the reception or the transmission in the first polarization, only receive RF signals in the mmWave frequency in the second polarization that is orthogonal to the first polarization.

20 Claims, 5 Drawing Sheets

ANTENNA SYSTEM FOR PORTABLE COMMUNICATION DEVICE FOR MILLIMETER WAVE COMMUNICATION

FIELD OF TECHNOLOGY

Certain embodiments of the disclosure relate to antenna systems and technologies for millimeter wave-based wireless communication. More specifically, certain embodiments of the disclosure relate to an antenna system for a portable communication device for millimeter wave (mmWave) communication.

BACKGROUND

Wireless telecommunication has witnessed advent of various signal transmission techniques, systems, and methods, such as use of beam forming techniques, for enhancing capacity of radio channels. For the advanced high-performance fifth generation communication networks, such as millimeter wave communication, there is a demand for innovative hardware systems, and technologies to support millimeter wave communication in effective and efficient manner. The fifth generation (5G) of mobile communications is envisioned to provide very high data rates, consistent connectivity, and very low latency with ultra-high reliability. There are many technical challenges to realize such envisioned features in the 5G mobile communications. Firstly, the antenna systems embedded in future portable communication devices (e.g. smartphones) may have strict requirements in terms of low power consumption (e.g. typically less than 1 mW) and size. Such constraints, and particularly the low power consumption, have a direct impact on the limited degree of beamforming capabilities, even if the antenna sizes could fit in most of the portable communication devices (e.g. smartphones). Secondly, 5G mm-wave antenna systems may be implemented in independent chipsets, due to their very different architecture and requirements for a close integration for beamforming and other 5G functions. This results in a technical challenge of densely packing multiple RF chains and antenna elements while ensuring their efficiency, avoiding intersymbol interference (ISI), and maintaining signal linearity with lowest insertion loss possible. Thirdly, the need for multi-antenna beamforming architectures is already well recognized to mitigate the high path loss experienced in the mm-wave spectrum. However, the need for this type of directional communications as well as to achieve angular coverage that is wide enough to ensure robustness and consistent connectively in different orientations of the portable communication device, may further impose yet another challenge for existing antenna systems for millimeter wave communication. The challenge is mainly in terms of maintenance of low power consumption, high antenna sensitivity, and adequate size of antenna systems that may fit within a small physical volume of a portable communication device (e.g. a smartphone).

Further limitations and disadvantages of conventional and traditional approaches will become apparent to one of skill in the art, through comparison of such systems with some aspects of the present disclosure as set forth in the remainder of the present application with reference to the drawings.

An antenna system is provided for a portable communication device for millimeter wave communication, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION OF THE DISCLOSURE

Certain embodiments of the disclosure may be found in an antenna system for a portable communication device for millimeter wave (mmWave) communication. Portable communication devices, such as mobile equipment, represent the leading edge of radio frequency (RF) personal communications, and one of the most challenging RF product as a result of the complexity inherent with multiple radios that operate and coexist within a small physical volume. The disclosed antenna system provides enhanced performance by maintenance of signal linearity, low power consumption with lowest insertion loss possible while efficiently operating within a small physical volume of the portable communication device. The disclosed antenna system provides high antenna sensitivity for ultra-high reliability for millimeter wave communication of the portable communication device with other communication devices, such as a base station or a repeater device. In the following description, reference is made to the accompanying drawings, which form a part hereof, and in which is shown, by way of illustration, various embodiments of the present disclosure.

Figure 1:
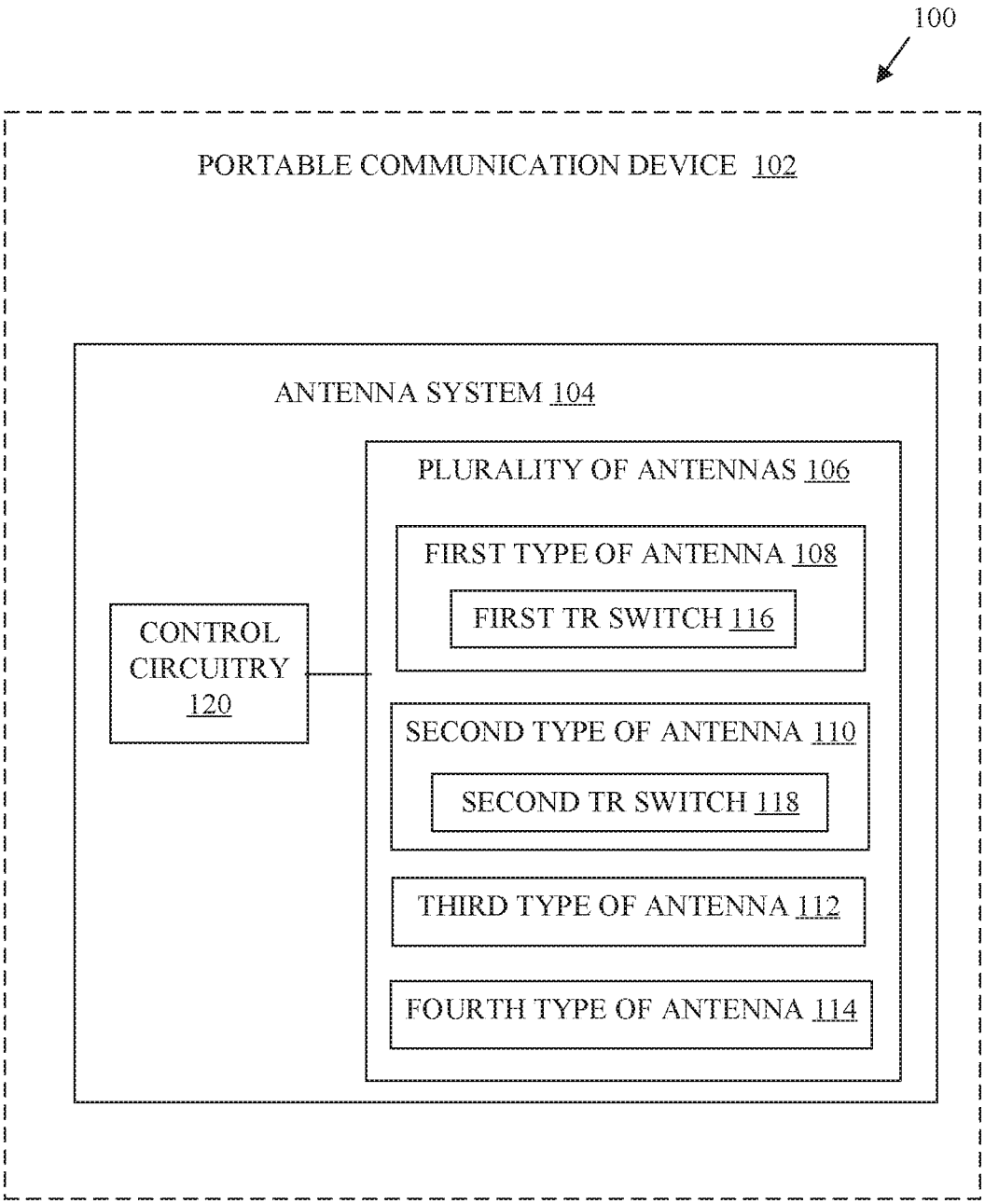
FIG. 1 is a block diagram of a portable communication device with an antenna system for millimeter wave communication, in accordance with an exemplary embodiment of the disclosure.

FIG. 1 is a block diagram of a portable communication device with an antenna system for millimeter wave communication, in accordance with an exemplary embodiment of the disclosure. With reference to FIG. 1, there is shown a portable communication device 102 with an antenna system 104. The antenna system 104 includes a plurality of antennas 106. The plurality of antennas 106 includes a plurality of different types of antennas, such as a first type of antenna 108, a second type of antenna 110, a third type of antenna 112, and a fourth type of antenna 114. The antenna system 104 may further include control circuitry 120.

The portable communication device 102 may correspond to a telecommunication hardware used by an end-user to communicate (e.g. a mobile equipment). Alternatively stated, the portable communication device 102 may refer a combination of the mobile equipment and subscriber identity module (SIM). Examples of the portable communication device 102 may include, but are not limited to a 5G-capable smartphone, an Evolved-universal terrestrial radio access-New radio Dual Connectivity (EN-DC) device, a New Radio (NR)-enabled mobile equipment, or a mmWave-enabled portable telecommunication device. The portable communication device 102 may facilitate communication in both sub 30 gigahertz to above 30 gigahertz. The band of radio frequencies in the electromagnetic spectrum from 30 to 300 gigahertz is usually referred to as extremely high frequency (EHF) communication. Such radio frequencies have wavelengths from ten to one millimeter, and referred to as millimeter wave (mmWave). In the present disclosure, radio frequencies approximately above 6 gigahertz may also be broadly interpreted and considered as mmWave. In one example, the portable communication device 102 may receive/transmit the RF signals from/to a base station via the antenna system 104. In another example, the portable communication device 102 may receive/transmit RF signals from/to a network node, such as a repeater device, via the antenna system 104.

The antenna system 104 includes the plurality of antennas 106 that are configured for at least mmWave-based cellular communication. The plurality of antennas 106 may be distributed at a plurality of different locations in the portable communication device 102. In accordance with an embodiment, the plurality of antennas 106 may be distributed and grouped at four different corners in the portable communication device 102. Alternatively, in accordance with another embodiment, the plurality of antennas 106 may be distributed at edge areas in the portable communication device 102.

In accordance with an embodiment, the antenna system 104 may further include various components, such as transmitter front-ends, receiver front-ends, a digital signal processor, a plurality of low-noise amplifiers, a plurality of phase shifters, a plurality of power combiners, a plurality of power dividers, and a plurality of power amplifiers, logical control units, 4G or 5G modems, phased lock loop (PLL) circuits, mixers, analog to digital converters (ADC), and digital to analog circuitry (DAC). In some embodiments, ADC and DAC may not be provided. In such an embodiment, the beamforming may be executed by processing signals in analog domain. In some embodiments, each antenna of the plurality of antennas 106 may be made of electrically conductive material, such as metal. In some embodiments, each antenna of the plurality of antennas 106 may be made of plastic and coated with electrically conductive material, such as metal, for mass production. In some embodiments, each antenna of the plurality of antennas 106 may be made of optical fiber for enhanced conduction in the millimeter wave frequency.

Each antenna of the plurality of antennas 106 may have a first polarization and a second polarization. In other words, each antenna of the plurality of antennas 106 may be a dual-polarized antenna configured to transmit and receive radio frequency (RF) waves for the millimeter wave communication in both horizontal and vertical polarizations. In accordance with an embodiment, the first polarization is a horizontal polarization and the second polarization is a vertical polarization. In accordance with another embodiment, the first polarization is a vertical polarization and the second polarization is a horizontal polarization. Each antenna of the plurality of antennas 106 may have a physical size that is less than or equal to a wavelength of the mmWave frequency. In an implementation, each antenna of the plurality of antennas 106 may be a patch antenna. In an implementation, the plurality of antennas 106 may be grouped into a plurality of different sets of antennas, where each set of antennas may collectively function as miniature planar phased array antenna.

The plurality of antennas 106 may include a plurality of different types of antennas. The antenna system 104 ensures best trade-offs in terms of performance, cost, and complexity, for mmWave communication as a result of the use of the plurality of different types of antennas that are distributed at different locations within the portable communication device 102, and the use of both polarization for RF signals communication in mmWave frequency. Different examples of distribution of the plurality of antennas 106 are shown and described, for example, in FIGS. 2A to 2D. The first type of antenna 108 of the plurality of different types of antennas may include suitable logic, circuitry, and/or interfaces that may be configured to switch between reception of a first radio frequency (RF) signal in a mmWave frequency and transmission of a second RF signal in the mmWave frequency in the first polarization. The first type of antenna 108, concurrently with the reception or the transmission in the first polarization, may be configured to only receive RF signals in the mmWave frequency in the second polarization that is orthogonal to the first polarization. The received RF signals may be at least one of the first RF signal or other RF signals. The first type of antenna 108 may include a first transmit-receive (TR) switch 116 that may switch between the reception of the first RF signal in the mmWave frequency and the transmission of the second RF signal in the mmWave frequency in the first polarization.

The second type of antenna 110 may include suitable logic, circuitry, and/or interfaces that may be configured to switch between reception of the first RF signal in the mmWave frequency and transmission of the second RF signal in the mmWave frequency in the second polarization. The second type of antenna 108, concurrently with the reception or the transmission in the second polarization, may be configured to only receive the RF signals in the mmWave frequency in the first polarization. The second type of antenna 110 may include a second transmit-receive (TR) switch 118 that may switch between the reception of the first RF signal in the mmWave frequency and the transmission of the second RF signal in the mmWave frequency in the second polarization.

The third type of antenna 112 may include suitable logic, circuitry, and/or interfaces that may be configured to only transmit in the mmWave frequency in the first polarization and only receive in the mmWave frequency in the second polarization. The fourth type of antenna 114 may include suitable logic, circuitry, and/or interfaces that may be configured to only receive in the mmWave frequency in the first polarization (e.g. vertical polarization) as well as in the second polarization (e.g. horizontal polarization).

The control circuitry 120 may include suitable logic and/or interfaces that may be configured to combine a plurality of RF signals received in the mmWave frequency at the plurality of antennas 106 distributed at the plurality of different locations to generate a combined signal to increase sensitivity of the antenna system 102 for the millimeter wave communication. The control circuitry 120 may be further configured to generate a beam of RF signals in a first radiation pattern based on sharing of a plurality of components of the plurality of antennas 106 for the millimeter wave communication. In accordance with an embodiment, the plurality of antennas 106 may operate under the control of the control circuitry 120. The control circuitry 120 may be configured to generate radio frequencies in the electromagnetic spectrum of mmWave, and further control propagation, a direction and angle of the RF beam in millimeter wave frequency through the plurality of antennas 106 for the millimeter wave communication with a base station (e.g. a gNB) for high throughput data communication.

Figure 2A:
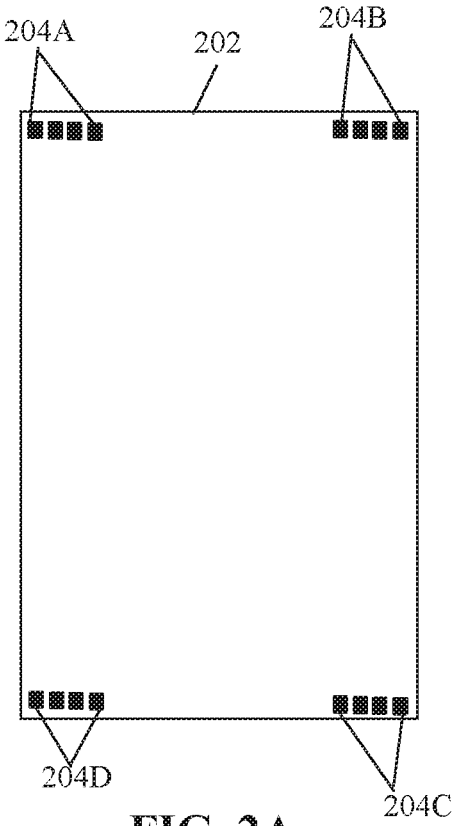
FIGS. 2A, 2B, 2C, and 2D are diagrams that illustrate different exemplary configurations of a plurality of antennas of an antenna system within a portable communication device, in accordance with an exemplary embodiment of the disclosure.

FIGS. 2A, 2B, 2C, and 2D illustrate different exemplary configurations of a plurality of antennas of an antenna system within a portable communication device, in accordance with an exemplary embodiment of the disclosure. FIGS. 2A-2D are described in conjunction with elements from FIG. 1. With reference to FIG. 2A, there is shown a portable communication device 202, such as a mobile equipment. The portable communication device 202 includes a plurality of antennas (e.g. plurality of antennas 106 of FIG. 1) that are grouped as a first set of antennas 204A, a second set of antennas 204B, a third set of antennas 204C, and a fourth set of antennas 204D. In a first configuration, the first set of antennas 204A, the second set of antennas 204B, the third set of antennas 204C, and the fourth set of antennas 204D may be arranged at four different corners in the portable communication device 202, as shown, in an example. In this embodiment, each antenna of the first set of antennas 204A, the second set of antennas 204B, the third set of antennas 204C, and the fourth set of antennas 204D may be arranged in a linear order, and thus each set of antenna forms a row.

Figure 2B:
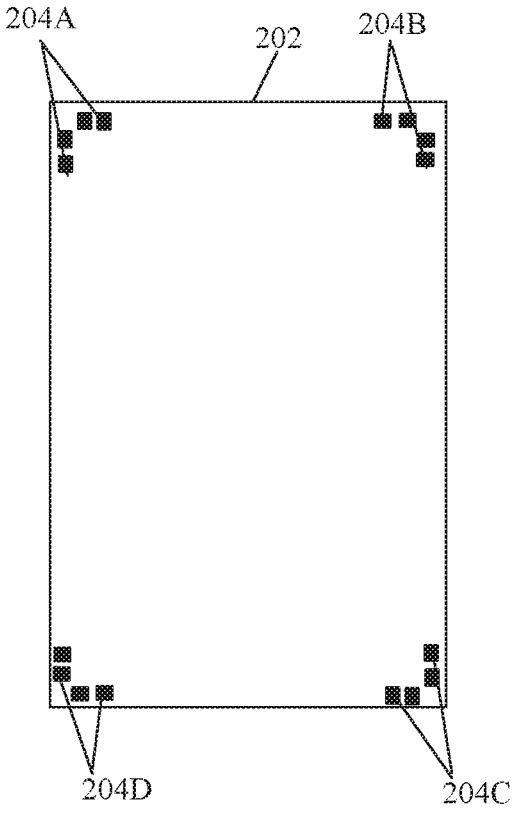

With reference to FIG. 2B, there is shown a second configuration of the plurality of antennas within the portable communication device 202. In the second configuration, similar to the first configuration (of FIG. 2A), the plurality of antennas (e.g. plurality of antennas 106) are also grouped as the first set of antennas 204A, the second set of antennas 204B, the third set of antennas 204C, and the fourth set of antennas 204D and may be arranged at four different corners in the portable communication device 202. In the second configuration, instead of the arrangement in the linear order or in a row, each of the first set of antennas 204A, the second set of antennas 204B, the third set of antennas 204C, and the fourth set of antennas 204D may be arranged in a right-angle (as shown in an example) or may be concentrated at each corner of the portable communication device 202.

Figure 2C:
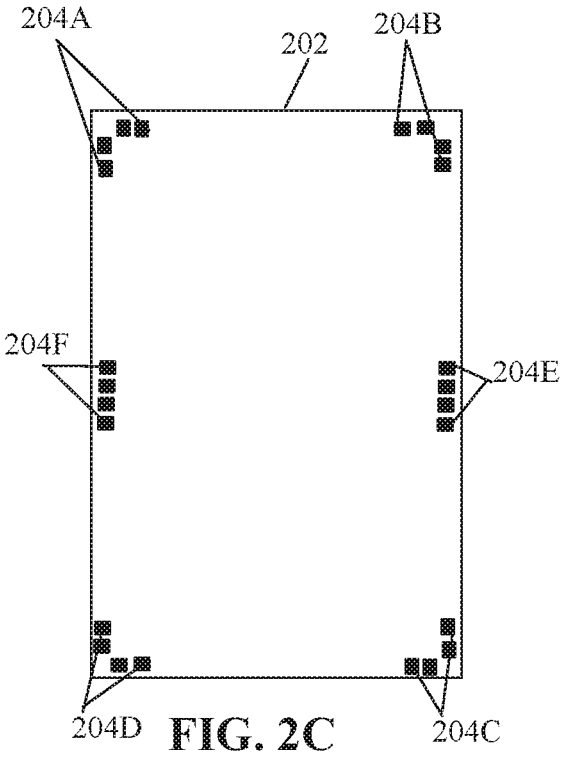

With reference to FIG. 2C, there is shown a third configuration of the plurality of antennas within the portable communication device 202. The third configuration is similar to that of the second configuration (of FIG. 2B), except that two or more sets of antennas may be additionally provided and arranged approximately in the middle edge areas along the vertical sides or horizontal sides of the portable communication device 202. In an example, as shown, a fifth set of antennas 204E and a sixth set of antennas 204F may be arranged on the two vertical sides of the portable communication device 202. In another example, the fifth set of antennas 204E and the sixth set of antennas 204F may be arranged on the two horizontal sides of the portable communication device 202.

Figure 2D:
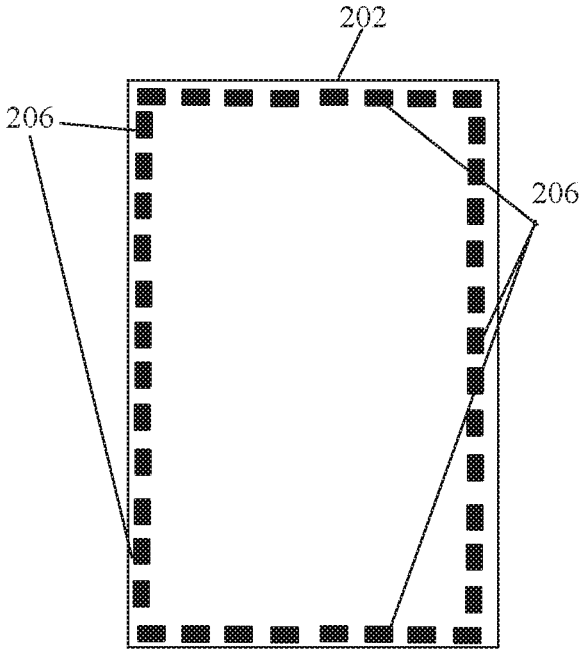

With reference to FIG. 2D, there is shown a fourth configuration of a plurality of antennas 206 within the portable communication device 202. In the fourth configuration, the plurality of antennas 206 are distributed at edge areas in the portable communication device 202. In accordance with an embodiment, the plurality of antennas 206 may be placed equidistant to each other, which may facilitate sharing of components and antennas for beamforming. In accordance with an embodiment, each antenna of the plurality of antennas 206 may include more than one beam means, i.e., each port in an antenna may have two or more independent signals reception means with independent phase relative to each other but the signals may still add up and may be directed to one port. In accordance with an embodiment, each antenna of the plurality of antennas 206 may operate in multiple band and the RF signals received or transmitted may be in multiple carrier frequencies, for example 28 and 39 GHz.

Figure 3A:
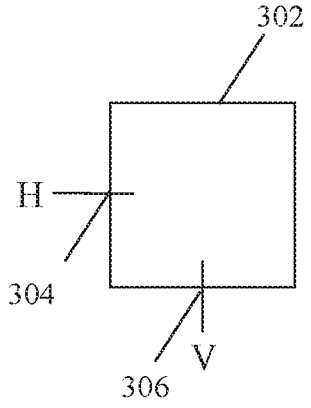
FIGS. 3A and 3B are diagrams that illustrate an exemplary antenna with vertical and horizontal polarization for millimeter wave communication, in accordance with an exemplary embodiment of the disclosure.
Figure 3B:
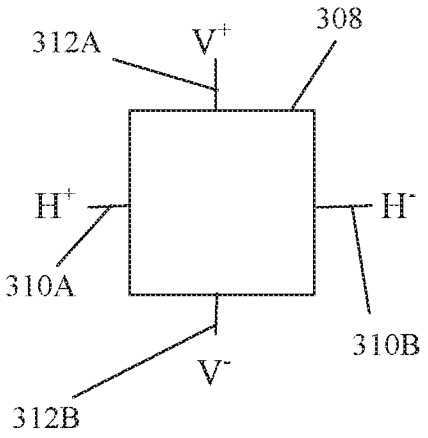

FIGS. 3A and 3B illustrate an exemplary antenna with vertical and horizontal polarization for millimeter wave communication, in accordance with an exemplary embodiment of the disclosure. FIGS. 3A and 3B are described in conjunction with elements from FIGS. 1 and 2A-2D. With reference to FIG. 3A, there is shown an antenna 302 having a horizontal polarization 304 and a vertical polarization 306. The antenna 302 may be one of the plurality of antennas 106. In this embodiment, the antenna 302 may be a dual-polarized patch antenna configured to communicate RF signals in both polarizations (i.e. the horizontal polarization 304 and the vertical polarization 306) at the same time. The horizontal polarization 304 refers to a form of antenna polarization in which electric field vector of an electro-magnetic wave (e.g. a propagating RF signal or a beam of RF signals) is parallel to plane of earth during reception or transmission of the RF signal or the beam of RF signals. The vertical polarization 306 refers to a form of antenna polarization in which electric field vector of an electro-magnetic wave (e.g. a propagating RF signal or a beam of RF signals) is perpendicular to the plane of earth during reception or transmission of the RF signal or the beam of RF signals.

In accordance with an embodiment, the antenna 302 may have a physical size that is less than or equal to a wavelength of the mmWave frequency. The disclosed antenna system 104 takes advantage of the behavior and small physical size of each antenna, such as the antenna 302. Because of the small physical size of the antenna 302, each antenna may be conveniently shaped for dual polarization, and is therefore cost-effective for mmWave communication. Further, in the mmWave communication, more than one antenna may be used to perform beamforming, thus the small physical size of antenna and communication of RF signals in the vertical as well as horizontal polarization enable to pack more antennas within small physical volume of the portable communication device 102. Furthermore, the distribution of the plurality of antennas 106 at different locations within the portable communication device 102 in combination with the use of the horizontal polarization 304 and the vertical polarization 306 provides diversity as well as ensures high power of RF signals by combining of such RF signals for better antenna sensitivity of the antenna system 104.

In certain scenarios, RF signals or a beam of RF signals may be received in one polarization but may not be received as much in the other polarization. Thus, having the antenna 302 to operate in both polarizations (i.e. the horizontal polarization 304 and the vertical polarization 306), the portable communication device 102 may then have the ability to either select one, select both to operate at the same time, or even combine RF signals received from both polarizations, thereby increasing performance and enhanced antenna sensitivity for mmWave communication as compared to a conventional antenna configured for mmWave communication.

With reference to FIG. 3B, there is shown an antenna 308 having a differential polarization, such as a positively and a negatively charged horizontal polarization points (or ends) 310A and 310B and a positively and a negatively charged vertical polarization points (or ends) 312A and 312B. Similar to the antenna 302 (of FIG. 3A), the antenna 308 may be a dual-polarized patch antenna configured to communicate RF signals in both polarizations (i.e. the horizontal polarization 304 and the vertical polarization 306) at the same time. In an implementation, the antenna 308 may be one of the plurality of antennas 106 (of FIG. 1).

FIGS. 4A, 4B, 4C, and 4D illustrate different arrangement of different types of antenna of an antenna system within a portable communication device, in accordance with various exemplary embodiments of the disclosure. FIG. 4A-4D are described in conjunction with elements from FIGS. 1, 2A-2D, 3A, and 3B.

Figure 4A:
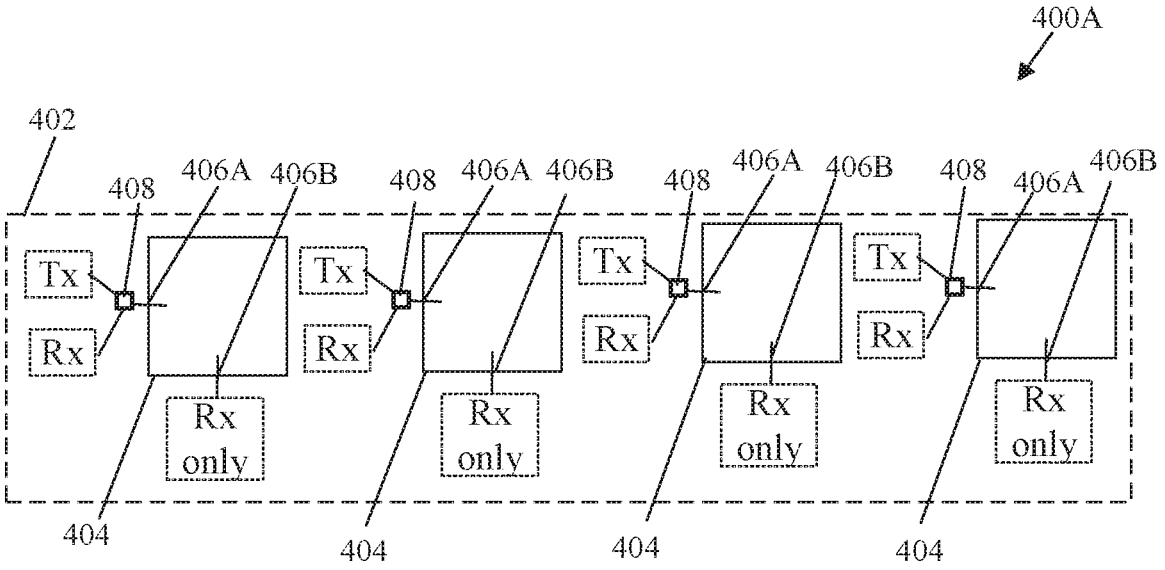
FIGS. 4A, 4B, 4C, and 4D are diagrams that illustrate different arrangements of different types of antenna of an antenna system within a portable communication device, in accordance with various exemplary embodiments of the disclosure.

With reference to FIG. 4A, there is shown a first arrangement 400A of a set of antennas 402. The first arrangement 400A includes a sequential arrangement of only one type of antennas, such as a first type of antennas 404. In this embodiment, each antenna of the set of antennas 402 may be a patch antenna. Each antenna of the set of antennas 402 has a first end 406A configured to communicate in a horizontal polarization and a second end 406B configured to communicate in a vertical polarization that is orthogonal to the horizontal polarization. The first type of antenna 402 may be coupled with a first TR switch 408. The first TR switch 408 may correspond to the first TR switch 116 (FIG. 1) The first type of antenna 404 may be configured to switch, at the first end 406A, between reception of a first radio frequency (RF) signal in a mmWave frequency (e.g. a carrier signal frequency in mmWave range) and transmission of a second RF signal in the same mmWave frequency in the horizontal polarization (e.g. by the first TR switch 408). Further, concurrently with the reception or the transmission in the horizontal polarization, the first type of antenna 402 only receive RF signals in the mmWave frequency in the vertical polarization at the second end 406B. The received RF signals is at least one of the first RF signal or other RF signals. For example, from the second end 406B of each antenna, RF signals may be received from a base station (e.g. gNB) via vertical polarization and from the first end 406A, RF signals may be transmitted to the base station at the same time in a same mmWave frequency in horizontal polarization. Beneficially, in the first arrangement 400A, RF signals may be transmitted at horizontal polarization and received at the vertical polarization. These RF signals at different polarization may not interact (or in some cases may have minimum or negligible interaction avoiding ISI) with each other as the horizontal polarization is executed orthogonal to the vertical polarization. Thus, transmission (Tx) and reception (Rx) may be executed at the same time without having any adverse effect on performance. Typically, low noise amplifiers (LNA) are used in the receiver chain and power amplifiers (PA) in the transmitter chain in an antenna system, such as the antenna system 104. In this case, i.e., in the first type of antenna 404, when the LNA is ON, the PA may be turned ON or OFF without affecting the other components, such as the LNA, of the antenna system 104. Beneficially, this maintains the signal linearity and to provide isolation between transmit and receive chains, with the lowest insertion loss possible for efficient and high performance mmWave communication. Moreover, a conventional patch antenna at lower frequencies (i.e. lower than mmWave frequency) is large (more than 1 cm). In contrast, the patch antenna, such as each of the first type of antenna 404, is very small (1/10 th as compared to antenna operating at lower frequencies or at least less than 1 cm). Thus, less area is required for a single antenna as compared to conventional patch antenna operating at lower frequencies, and because there is less area, each antenna may be conveniently shaped for dual polarization, and is therefore cost-effective for mmWave communication.

Figure 4B:
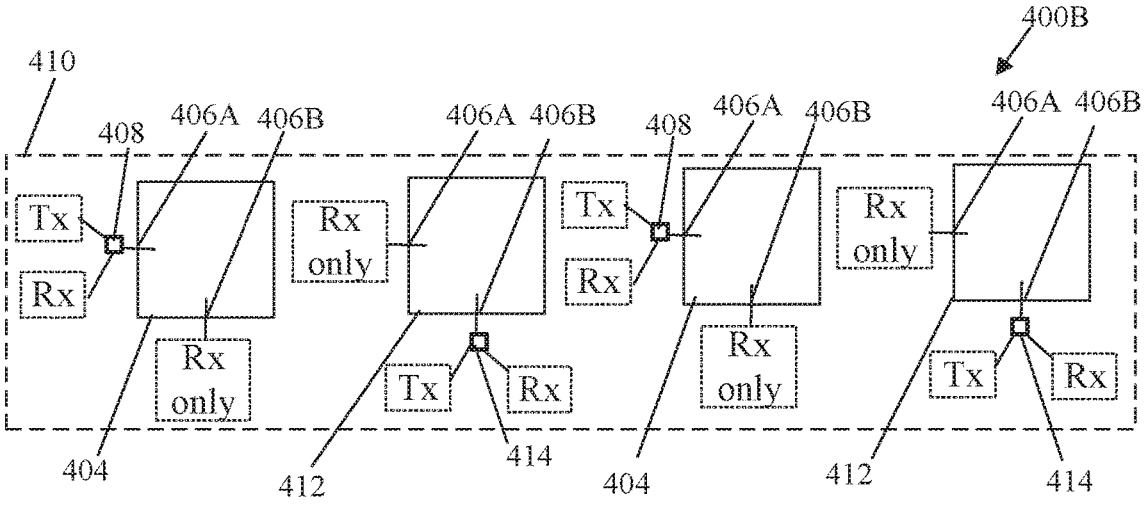

With reference to FIG. 4B, there is shown a second arrangement 400B of a set of antennas 410. The second arrangement 400B includes an alternative arrangement of the first type of antennas 404 (of FIG. 4A) and a second type of antenna 412. The second type of antenna 412 may be coupled with a second TR switch 414. The second TR switch 414 may correspond to the second TR switch 118 (FIG. 1). The second type of antenna 412 may be configured to switch (e.g. by the second TR switch 414), at the second end 406B (instead of the first end 406A in the horizontal polarization as in the first type of antenna 404), between reception of the first RF signal in a mmWave frequency (e.g. a carrier signal frequency in mmWave range) and transmission of a second RF signal in the same mmWave frequency in the vertical polarization. Further, concurrently with the reception or the transmission in the vertical polarization, the second type of antenna 412 may be configured to only receive RF signals in the mmWave frequency in the horizontal polarization at the first end 406A. The received RF signals is at least one of the first RF signal or other RF signals. For example, from the second end 406B of each antenna, RF signals may be either received or transmitted at a given timepoint from/to a base station (e.g. gNB) via vertical polarization, whereas from the first end 406A, RF signals may be only received at the given timepoint from the base station in a same mmWave frequency in horizontal polarization. Beneficially, the second arrangement 400B ensures enhanced antenna sensitivity and provides an ability to an antenna system (such as the antenna system 104) to detect even a fading RF signal having very low signal strength, which is otherwise undetectable by conventional antenna systems.

Figure 4C:
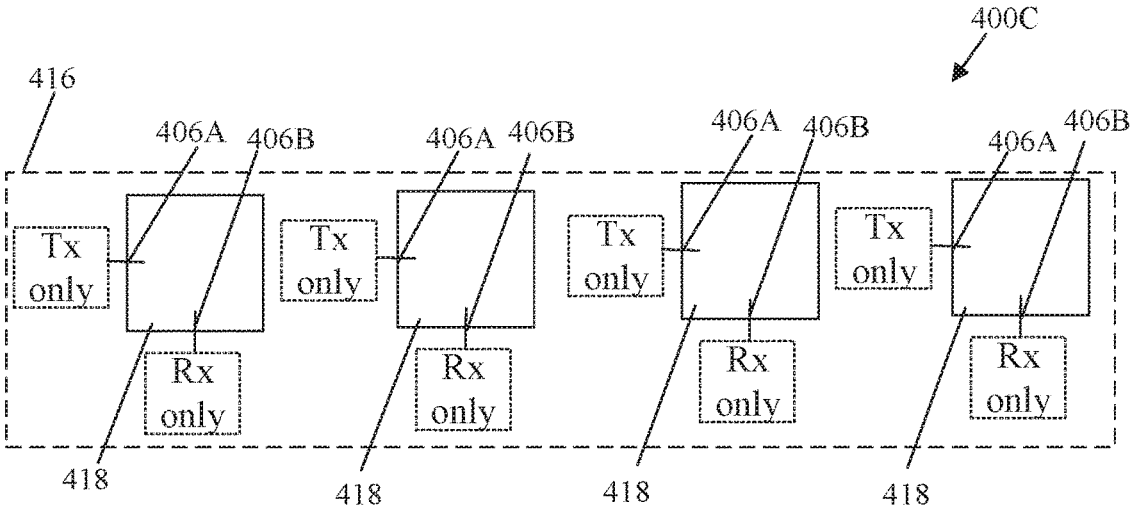

With reference to FIG. 4C, there is shown a third arrangement 400C of a set of antennas 416. The third arrangement 400C includes a sequential arrangement of only a third type of antenna 418. The third type of antenna 418 may be configured to only transmit (RF signals) in the mmWave frequency in the horizontal polarization at the first end 406A of the third type of antenna 418 and only receive in the mmWave frequency in the vertical polarization at the second end 406B of the third type of antenna 418.

Figure 4D:
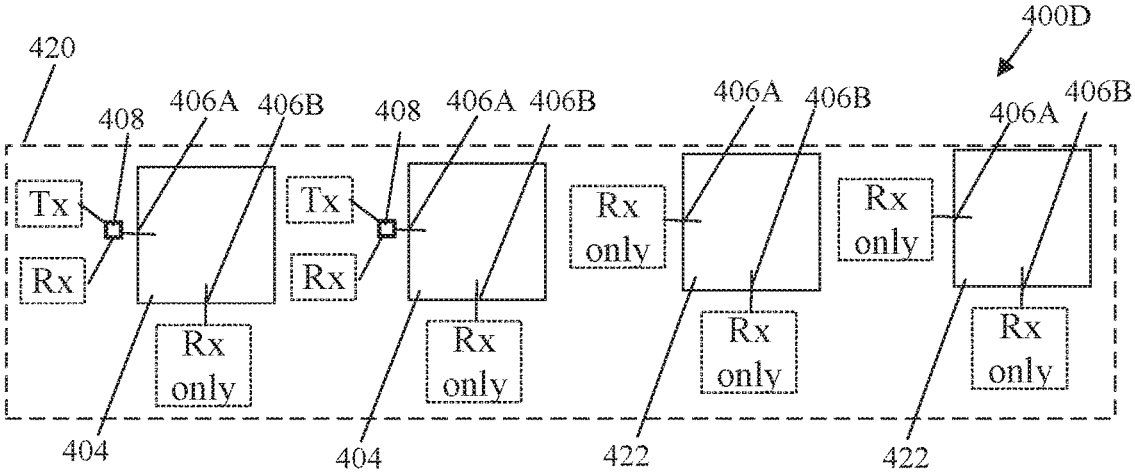

With reference to FIG. 4D, there is shown a fourth arrangement 400D of a set of antennas 420. The fourth arrangement 400D includes a combination of the first type of antennas 404 (of FIG. 4A) and a fourth type of antenna 422. The fourth type of antenna 422 may be configured to only receive (RF signals) in the mmWave frequency in the horizontal polarization at the first end 406A as well as in the vertical polarization at the second end 406B.

In accordance with an embodiment, a portable communication device (e.g. the portable communication device 102 or 202) may include same type of arrangement of antennas (e.g. the arrangement 400A, 400B, 400C, or 400D) (e.g. four sets of antennas 402, 410, 416, or 420) at four different corners or edge areas in the portable communication device. In accordance with another embodiment, different combination of the first arrangement 400A, the second arrangement 400B, the third arrangement 400C, and the fourth arrangement 400D, may be arranged in a row, in corners, or edge areas of the portable communication device (e.g. the portable communication device 102 or 202). In accordance with yet another embodiment, all the four types of arrangement 400A to 400D, may be distributed within the portable communication device (e.g. the portable communication device 102 or 202) at different locations to increase diversity and antenna sensitivity of the antenna system 104.

Figure 5A:
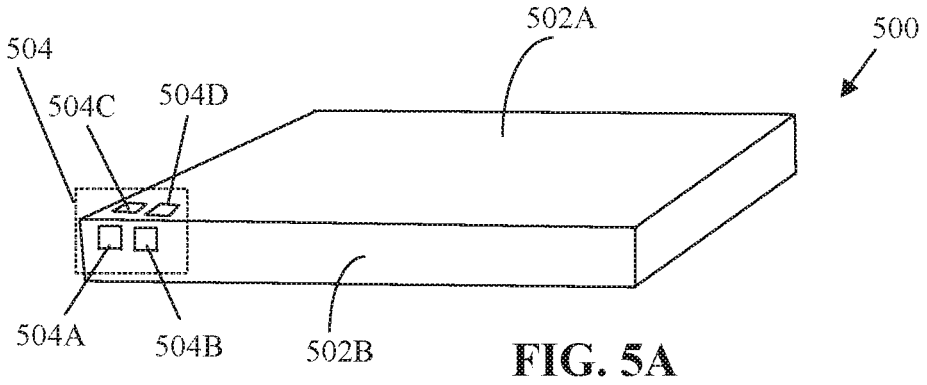
FIG. 5A is a diagram that illustrates an exemplary configuration of a plurality of antennas of an antenna system for multiple-input and multiple-output (MIMO) spatial multiplexing within a portable communication device, in accordance with an exemplary embodiment of the disclosure.

FIG. 5A is a diagram that illustrates an exemplary configuration of a plurality of antennas of an antenna system for multiple-input and multiple-output (MIMO) spatial multiplexing within a portable communication device, in accordance with an exemplary embodiment of the disclosure. FIG. 5A is described in conjunction with elements from FIGS. 1, 2A to 2D, 3A, 3B, and 4A to 4D. With reference to FIG. 5A, there is shown a perspective side view of a portable communication device 500, such as a mobile equipment. The portable communication device 500 includes a first set of antennas 504. In this embodiment, the first set of antennas 504 includes four antennas, a first antenna 504A, a second antenna 504B, a third antenna 504C, and a fourth antenna 504D. In this embodiment, the first antenna 504A and the second antenna 504B are arranged on a side portion 502B of a first corner of the portable communication device 500, as shown in an example. The third antenna 504C and the fourth antenna 504D are arranged on a rear portion 502A of the first corner of the portable communication device 500. Alternatively, in an implementation, the third antenna 504C and the fourth antenna 504D may be arranged on a front portion (not shown) of the first corner of the portable communication device 500. Alternatively, in some embodiments, two or more antennas may be placed at the front portion as well as at the rear portion 502A and the side portion 502B of the portable communication device 500. Similar to the first set of antennas 504, there may be other set of antennas, such as a second, third, and a fourth set of antennas, provided at different locations (e.g. rear or front side of all four corners includes side portions or edges as shown for example, in FIGS. 2A to 2D) of the portable communication device 500. Such different sets of antennas may be collectively referred to as a plurality of antennas (e.g. the plurality of antennas 106 of FIG. 1). In accordance with an embodiment, the first set of antennas 504 may be configured for at least mmWave-based cellular communication and may execute MIMO spatial multiplexing for high throughput data communication (without a T/R switch). Each of the first set of antennas 504 may be a dual-polarized patch antenna configured to communicate RF signals (i.e. transmit and receive) in both polarizations at the same time (or at different time as per need). In an example, the first set of antennas 504 may collectively function as miniature phased array antenna.

Figure 5B:
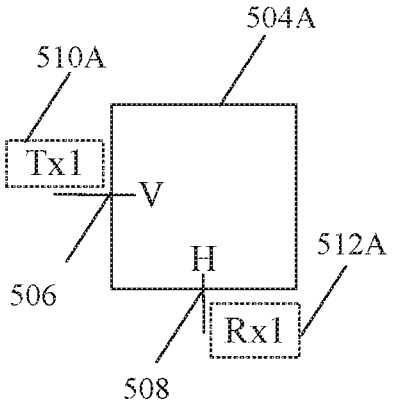
FIGS. 5B, 5C, 5D, and 5E are diagrams that illustrate the plurality of antennas of FIG. 5A for MIMO spatial multiplexing within the portable communication device, in accordance with an exemplary embodiment of the disclosure.

FIGS. 5B, 5C, 5D, and 5E are diagrams that illustrate the plurality of antennas of FIG. 5A for MIMO spatial multiplexing within the portable communication device, in accordance with an exemplary embodiment of the disclosure. FIGS. 5B, 5C, 5D, and 5E are described in conjunction with elements from FIGS. 1, 2A to 2D, 3A, 3B, 4A to 4D, and 5A. With reference to FIG. 5B, there is shown the first antenna 504A (of FIG. 5A) that includes a first transmitter 510A (also represented as Tx1) at a first end configured to transmit in a vertical polarization 506 and a first receiver 512A (also represented as Rx1) at a second end 508 configured to receive in a horizontal polarization 508. In this embodiment, the first antenna 504A may be a dual-polarized patch antenna configured to communicate RF signals (i.e. transmit and receive) in both polarizations (i.e. the vertical polarization 506 and the horizontal polarization 508) at the same time (or at different time as per need). In accordance with an embodiment, the first antenna 504A may have a physical size that is less than or equal to a wavelength of the mmWave frequency.

Figure 5C:
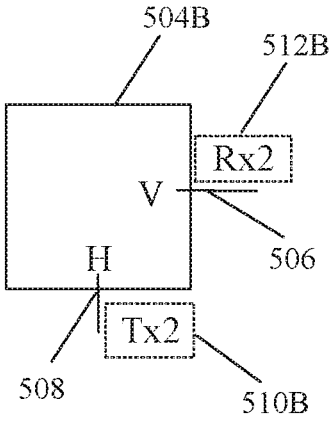
Figure 5D:
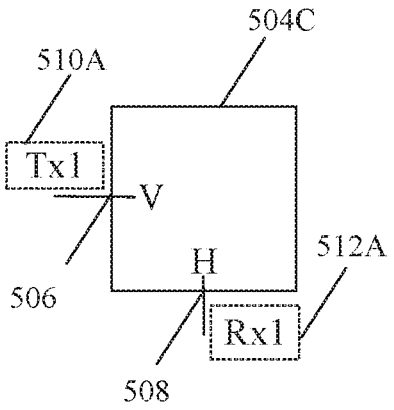
Figure 5E:
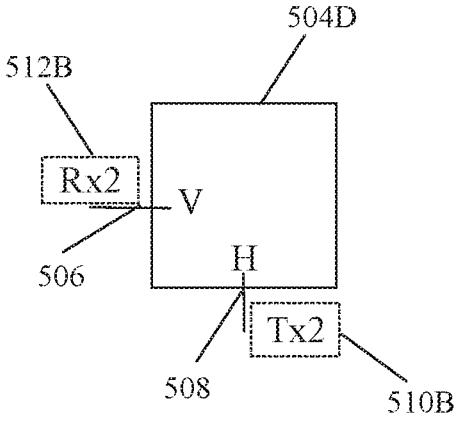

With reference to FIG. 5C, there is shown the second antenna 504B that includes a second transmitter 510B (also represented as Tx2) at a second end configured to transmit in the horizontal polarization 508 and a second receiver 512B (also represented as Rx2) at a third end configured to receive in the vertical polarization 506. The second antenna 504B may be one of the first set of antennas 504 of FIG. 5A. With reference to FIG. 5D, there is shown the third antenna 504C that is same as of the first antenna 504A, and thus includes the first transmitter 510A at the first end configured to transmit in the vertical polarization 506 and the first receiver 512A at the second end configured to receive in the horizontal polarization 508. The third antenna 504C may be one of the first set of antennas 504 of FIG. 5A. With reference to FIG. 5E, there is shown the fourth antenna 504D that is similar to that of the second antenna 504B but may have the second receiver 512B mounted at a different position (i.e. at the first end instead of the third end) as compared to the second antenna 504B. The fourth antenna 504D thus includes the second transmitter 510B at the second end configured to receive in the horizontal polarization 508 and the second receiver 512B at the first end configured to receive in the vertical polarization 506.

The first antenna 504A, the second antenna 504B, the third antenna 504C, and the fourth antenna 504D are configured to perform MIMO spatial multiplexing to receive and transmit RF signals (or beam of RF signals) from/to a radio access node (such as a base station or a repeater device) under the control of the control circuitry 120. The spatial multiplexing refers to a transmission technique in MIMO wireless communication to transmit independent and separately encoded data signals, so-called streams (e.g. stream 1 and stream 2), from each of the multiple transmit antennas. In some cases, two or more transmitters may be grouped as a phased array to transmit a single beam of RF signals (for beamforming purposes). In some cases, a same data signal may be split into two sub-signals and separately transmitted via two transmitters but may be recovered at the receiver side. For example, the first transmitter 510A (of the first antenna 504A and the third antenna 504C) may be configured to transmit stream 1 in the vertical polarization 506. The second transmitter 510B (of the second antenna 504B and the fourth antenna 504D) may be configured to transmit stream 2 in the horizontal polarization 508. The stream 1 and stream 2 transmitted at different polarization may not interact (or in some cases may have minimum or negligible interaction avoiding ISI) with each other as the horizontal polarization 508 is executed orthogonal to the vertical polarization 506 in addition to the spatial multiplexing of MIMO. This means that a number of streams may be transmitted in parallel, resulting to an increase of the spectral efficiency (increased number of bits per second and per Hz that can be transmitted over the wireless channel with improved reduction in ISI due to use of different polarization). In accordance with an embodiment, spatial multiplexing may be further used for simultaneous transmission to multiple receivers, known as space-division multiple accessing. Similarly, the first receiver 512A (of the first antenna 504A and the third antenna 504C) may be configured to receive first stream (stream 1) of RF signals in the horizontal polarization 508. The second receiver 512B (of the second antenna 504B and the fourth antenna 504D) may be configured to receive second stream (stream 2) of RF signals in the vertical polarization 506. In certain scenarios, RF signals or a beam of RF signals may be received in one polarization but may not be received as much in the other polarization. Thus, having the first antenna 504A, the second antenna 504B, the third antenna 504C, and the fourth antenna 504D of the first set of antennas 504 to operate in both polarizations (i.e. the vertical polarization 506 and the horizontal polarization 508), the portable communication device 500 may then have the ability to select both to operate at the same time, or even combine RF signals received from both polarizations, thereby increasing performance and enhanced antenna sensitivity (as well as diversity due to use of different types of antenna at different locations) for mmWave communication as compared to a conventional antenna configured for mmWave communication.

In accordance with an embodiment, the reception and transmission at each antenna (i.e. the first antenna 504A, the second antenna 504B, the third antenna 504C, and the fourth antenna 504D) of the set of antennas 504 may occur concurrently (at the same time) in the same (or different) mmWave carrier frequency but at two different polarizations that are orthogonal to each other for increased data rates while maintaining minimum ISI. Beneficially, this maintains the signal linearity and to provide isolation between transmit and receive chains, with the lowest insertion loss possible for efficient and high performance mmWave communication. Moreover, a conventional patch antenna at lower frequencies (i.e. lower than mmWave frequency) is large (more than 1 cm). In contrast, the patch antenna, such as each of the first set of antennas 504, is very small (1/10th as compared to antenna operating at lower frequencies or at least less than 1 cm). Thus, less area is required for a single antenna as compared to conventional patch antenna operating at lower frequencies, and because there is less area, each antenna may be conveniently shaped for dual polarization, and is therefore cost-effective for MIMO spatial multiplexing in mmWave communication.

In accordance with an embodiment, the antenna system (such as the antenna system 104) for the portable communication device 102, may comprise a plurality of antennas (such as the plurality of antennas 106) configured for at least mmWave-based cellular communication, and are distributed at a plurality of different locations in the portable communication device 102. Each antenna of the plurality of antennas 106 has a first polarization and a second polarization. The plurality of antennas 106 may comprise a plurality of different types of antennas. A first type of antenna (e.g. the first type of antenna 108) of the plurality of different types of antennas may be configured to switch between reception of a first radio frequency (RF) signal in a mmWave frequency and transmission of a second RF signal in the mmWave frequency in the first polarization. The first type of antenna 108, concurrently with the reception or the transmission in the first polarization, may be further configured to only receive RF signals in the mmWave frequency in the second polarization that is orthogonal to the first polarization. The received RF signals is at least one of the first RF signal or other RF signals. A second type of antenna (e.g. the second type of antenna 110) of the plurality of different types of antennas may be configured to switch between reception of the first RF signal in the mmWave frequency and transmission of the second RF signal in the mmWave frequency in the second polarization, and concurrently with the reception or the transmission in the second polarization, only receive the RF signals in the mmWave frequency in the first polarization.

In accordance with an embodiment, the plurality of antennas 106 may further comprise the third type of antenna 112 configured to only transmit in the mmWave frequency in the first polarization and only receive in the mmWave frequency in the second polarization. The plurality of antennas 106 may further comprises the fourth type of antenna 114 configured to only receive in the mmWave frequency in the first polarization and in the second polarization. The plurality of antennas 106 may comprise a plurality of different sets of antennas, wherein each set of antennas of the plurality of different sets of antennas may comprise at least one of: a sequential arrangement of only the first type of antennas (FIG. 4A), a sequential arrangement of only the second type of antennas, a sequential arrangement of only the third type of antennas, a sequential arrangement of only the fourth type of antennas, an alternative arrangement of the first type of antennas and the second type of antennas (FIG. 4B), or a combination of different types of antennas from the plurality of different types of antennas (FIG. 4C).

In accordance with an embodiment, the plurality of antennas 106 may comprise a first set of antennas, a second set of antennas, a third set of antennas, and a fourth set of antennas arranged at four different corners in the portable communication device 102 (FIGS. 2A and 2B). The plurality of antennas 106 may be distributed at edge areas in the portable communication device 102 (FIGS. 2C and 2D).

In accordance with an embodiment, the first polarization is the horizontal polarization 304 and the second polarization is a vertical polarization 306. In accordance with another embodiment, the first polarization is the vertical polarization 306 and the second polarization is the horizontal polarization 304. Each antenna of the plurality of antennas may have a physical size that is less than or equal to a wavelength of the mmWave frequency.

In accordance with an embodiment, the antenna system 104 may include the control circuitry 120 that may be configured to combine a plurality of RF signals received in the mmWave frequency at the plurality of antennas 106 distributed at the plurality of different locations to generate a combined signal to increase sensitivity of the antenna system 104. The control circuitry 120 may be configured to generate a beam of RF signals in a first radiation pattern based on sharing of a plurality of components of the plurality of antennas 106. The first type of antenna 108 may comprise a first transmit-receive (TR) switch 116 that may switch between the reception of the first RF signal in the mmWave frequency and the transmission of the second RF signal in the mmWave frequency in the first polarization. The second type of antenna 110 may comprise a second transmit-receive (TR) switch 118 that may switch between the reception of the first RF signal in the mmWave frequency and the transmission of the second RF signal in the mmWave frequency in the second polarization.

In accordance with an exemplary aspect of the disclosure, the portable communication device 102 may be provided. The portable communication device 102 may include the antenna system 104 that comprises the plurality of antennas 106 configured for mmWave-based cellular communication. The plurality of antennas 106 may be distributed at a plurality of different locations in the portable communication device 102 to increase diversity of the antenna system 104. Each antenna of the plurality of antennas has a first end (such as the first end 406A) configured to communicate in the horizontal polarization 304 and a second end (e.g. the second end 406B) configured to communicate in the vertical polarization 306 that is orthogonal to the horizontal polarization. The plurality of antennas 106 may comprise a plurality of different types of antennas to increase sensitivity of the antenna system 104. The first type of antenna 108 of the plurality of different types of antennas may be configured to switch, at the first end 406A, between reception of a first radio frequency (RF) signal in a mmWave frequency and transmission of a second RF signal in the mmWave frequency in the horizontal polarization 304; and concurrently with the reception or the transmission in the horizontal polarization, only receive RF signals in the mmWave frequency in the vertical polarization 306 at the second end 406B. The received RF signals is at least one of the first RF signal or other RF signals. Further, the second type of antenna 110 of the plurality of different types of antennas may be configured to switch between reception of the first RF signal in the mmWave frequency and transmission of the second RF signal in the mmWave frequency in the vertical polarization 306 at the second end 406B. Further, the second type of antenna 110 concurrently with the reception or the transmission in the vertical polarization, may be configured to only receive the RF signals in the mmWave frequency in the horizontal polarization at the first end 406A. A number of receivers (Rx) (or RF signals reception points) in the plurality of antennas 106 may be greater than a number of transmitters (Tx) in the plurality of antennas 106.

In accordance with an embodiment, the plurality of antennas 106 may comprise the third type of antenna 112 that may be configured to only transmit in the mmWave frequency in the horizontal polarization 304 at the first end 406A of the third type of antenna 112 and only receive in the mmWave frequency in the vertical polarization 306 at the second end 406B of the third type of antenna 112. The plurality of antennas 106 may comprise the fourth type of antenna 114 configured to only receive in the mmWave frequency in the horizontal polarization 304 at the first end 406A of the fourth type of antenna 114 and in the vertical polarization 306 at the second end 406B of the fourth type of antenna 114.

In accordance with an embodiment, the plurality of antennas 106 may be grouped as a first set of antennas, a second set of antennas, a third set of antennas, and a fourth set of antennas, which are arranged at four different corners in the portable communication device 102. In accordance with an embodiment, the portable communication device 102 may be a mobile equipment, such as a 5G-capable smartphone.

While various embodiments described in the present disclosure have been described above, it should be understood that they have been presented by way of example, and not limitation. It is to be understood that various changes in form and detail can be made therein without departing from the scope of the present disclosure. In addition to using hardware (e.g., within or coupled to a central processing unit ("CPU"), microprocessor, micro controller, digital signal processor, processor core, system on chip ("SOC") or any other device), implementations may also be embodied in software (e.g. computer readable code, program code, and/or instructions disposed in any form, such as source, object or machine language) disposed for example in a non-transitory computer-readable medium configured to store the software. Such software can enable, for example, the function, fabrication, modeling, simulation, description and/or testing of the apparatus and methods describe herein. For example, this can be accomplished through the use of general program languages (e.g., C, C++), hardware description languages (HDL) including Verilog HDL, VHDL, and so on, or other available programs. Such software can be disposed in any known non-transitory computer-readable medium, such as semiconductor, magnetic disc, or optical disc (e.g., CD-ROM, DVD-ROM, etc.). The software can also be disposed as computer data embodied in a non-transitory computer-readable transmission medium (e.g., solid state memory any other non-transitory medium including digital, optical, analogue-based medium, such as removable storage media). Embodiments of the present disclosure may include methods of providing the apparatus described herein by providing software describing the apparatus and subsequently transmitting the software as a computer data signal over a communication network including the internet and intranets.

It is to be further understood that the system described herein may be included in a semiconductor intellectual property core, such as a microprocessor core (e.g., embodied in HDL) and transformed to hardware in the production of integrated circuits. Additionally, the system described herein may be embodied as a combination of hardware and software. Thus, the present disclosure should not be limited by any of the above-described exemplary embodiments but should be defined only in accordance with the following claims and their equivalents.

What is claimed is:

1. An antenna system for a portable communication device, comprising:

a plurality of antennas configured for at least mmWave-based cellular communication, and are distributed at a plurality of different locations in the portable communication device, wherein each antenna of the plurality of antennas has a first polarization and a second polarization, wherein the plurality of antennas comprises a plurality of different types of antennas, and wherein a first type of antennas of the plurality of different types of antennas is configured to:

switch between reception of a first radio frequency (RF) signal in a mmWave frequency and transmission of a second RF signal in the mmWave frequency in the first polarization; and concurrently with the reception or the transmission in the first polarization, only receive RF signals in the mmWave frequency in the second polarization that is orthogonal to the first polarization, wherein the received RF signals is at least one of the first RF signal or other RF signals; and wherein a second type of antennas of the plurality of different types of antennas is configured to:

switch between reception of the first RF signal in the mmWave frequency and transmission of the second RF signal in the mmWave frequency in the second polarization, and concurrently with the reception or the transmission in the second polarization, only receive the RF signals in the mmWave frequency in the first polarization.

2. The antenna system of claim 1, wherein the plurality of antennas comprises a third type of antennas configured to only transmit in the mmWave frequency in the first polarization and only receive in the mmWave frequency in the second polarization.

3. The antenna system of claim 2, wherein the plurality of antennas comprises a fourth type of antennas configured to only receive in the mmWave frequency in the first polarization and in the second polarization.

4. The antenna system of claim 3, wherein the plurality of antennas comprises a plurality of different sets of antennas, wherein each set of antennas of the plurality of different sets of antennas comprises at least one of: a sequential arrangement of only the first type of antennas, a sequential arrangement of only the second type of antennas, a sequential arrangement of only the third type of antennas, a sequential arrangement of only the fourth type of antennas, an alternative arrangement of the first type of antennas and the second type of antennas, or a combination of different types of antennas from the plurality of different types of antennas.

5. The antenna system of claim 1, wherein the plurality of antennas comprises a first set of antennas, a second set of antennas, a third set of antennas, and a fourth set of antennas arranged at four different corners in the portable communication device.

6. The antenna system of claim 1, wherein the plurality of antennas are distributed at edge areas in the portable communication device.

7. The antenna system of claim 1, wherein the first polarization is a horizontal polarization and the second polarization is a vertical polarization.

8. The antenna system of claim 1, wherein the first polarization is a vertical polarization and the second polarization is a horizontal polarization.

9. The antenna system of claim 1, wherein each antenna of the plurality of antennas has a physical size that is less than or equal to a wavelength of the mmWave frequency.

10. The antenna system of claim 1, further comprises control circuitry, wherein the control circuitry is configured to combine a plurality of RF signals received in the mmWave frequency at the plurality of antennas distributed at the plurality of different locations to generate a combined signal to increase sensitivity of the antenna system.

11. The antenna system of claim 1, further comprises control circuitry, wherein the control circuitry is configured to generate a beam of RF signals in a first radiation pattern based on sharing of a plurality of components of the plurality of antennas.

12. The antenna system of claim 1, wherein the first type of antennas comprises a first transmit-receive (TR) switch that switches between the reception of the first RF signal in the mmWave frequency and the transmission of the second RF signal in the mmWave frequency in the first polarization.

13. The antenna system of claim 1, wherein the second type of antennas comprises a second transmit-receive (TR) switch that switches between the reception of the first RF signal in the mmWave frequency and the transmission of the second RF signal in the mmWave frequency in the second polarization.

14. A portable communication device, comprising:

an antenna system that comprises a plurality of antennas configured for mmWave-based cellular communication, wherein the plurality of antennas are distributed at a plurality of different locations in the portable communication device to increase diversity of the antenna system, wherein each antenna of the plurality of antennas has a first end configured to communicate in a horizontal polarization and a second end configured to communicate in a vertical polarization that is orthogonal to the horizontal polarization, and wherein the plurality of antennas comprises a plurality of different types of antennas to increase sensitivity of the antenna system, and wherein a first type of antennas of the plurality of different types of antennas is configured to:

switch, at the first end, between reception of a first radio frequency (RF) signal in a mmWave frequency and transmission of a second RF signal in the mmWave frequency in the horizontal polarization; and concurrently with the reception or the transmission in the horizontal polarization, only receive RF signals in the mmWave frequency in the vertical polarization at the second end, wherein the received RF signals is at least one of the first RF signal or other RF signals, and wherein a second type of antennas of the plurality of different types of antennas is configured to:

switch between reception of the first RF signal in the mmWave frequency and transmission of the second RF signal in the mmWave frequency in the vertical polarization at the second end, and concurrently with the reception or the transmission in the vertical polarization, only receive the RF signals in the mmWave frequency in the horizontal polarization at the first end, and wherein a number of receivers in the plurality of antennas is greater than a number of transmitters in the plurality of antennas.

15. The portable communication device of claim 14, wherein the plurality of antennas comprises a third type of antennas configured to only transmit in the mmWave frequency in the horizontal polarization at the first end of the third type of antennas and only receive in the mmWave frequency in the vertical polarization at the second end of the third type of antennas.

16. The portable communication device of claim 15, wherein the plurality of antennas comprises a fourth type of antennas configured to only receive in the mmWave frequency in the horizontal polarization at the first end of the fourth type of antennas and in the vertical polarization at the second end of the fourth type of antennas.

17. The portable communication device of claim 16, wherein the plurality of antennas comprises a plurality of different sets of antennas, wherein each set of antennas of the plurality of different sets of antennas comprises at least one of: a sequence of only the first type of antennas, a sequence of only the second type of antennas, a sequence of only the third type of antennas, a sequence of only the fourth type of antennas, an alternative arrangement of the first type of antennas and the second type of antennas, an alternative arrangement of the first type of antennas, the second type of antennas, the third type of antennas, and the fourth type of antennas, or a combination of different types of antennas from the plurality of different types of antennas.

18. The portable communication device of claim 14, wherein the plurality of antennas are grouped as a first set of antennas, a second set of antennas, a third set of antennas, and a fourth set of antennas, which are arranged at four different corners in the portable communication device.

19. The portable communication device of claim 14, wherein the plurality of antennas are distributed at edge areas in the portable communication device.

20. The portable communication device of claim 14, wherein the portable communication device is a mobile equipment.

* * * * *